US009228313B2

(12) United States Patent
Mägi

(10) Patent No.: US 9,228,313 B2
(45) Date of Patent: Jan. 5, 2016

(54) RESTORATION AND REINFORCEMENT OF A SCARP

(71) Applicant: AMHOLD AS, Tallinn (EE)

(72) Inventor: Arvu Mägi, Tallinn (EE)

(73) Assignee: Amhold A/S, Tallin (EE)

( * ) Notice: Subject to any disclaimer, the term of this patent is extended or adjusted under 35 U.S.C. 154(b) by 0 days.

(21) Appl. No.: 14/510,374

(22) Filed: Oct. 9, 2014

(65) Prior Publication Data

US 2015/0159338 A1 Jun. 11, 2015

(30) Foreign Application Priority Data

Dec. 10, 2013 (EE) ..... 1300097 U

(51) Int. Cl.
*E02D 29/02* (2006.01)
*E02D 17/20* (2006.01)

(52) U.S. Cl.
CPC ..... *E02D 29/02* (2013.01); *E02D 17/202* (2013.01); *E02D 17/207* (2013.01); *E02D 29/0241* (2013.01)

(58) Field of Classification Search
CPC ..... E02D 17/20; E02D 17/202; E02D 17/207; E02D 29/02; E02D 29/0225; E02D 29/0233; E02D 29/0241
See application file for complete search history.

(56) References Cited

U.S. PATENT DOCUMENTS 4,117,686 A * 10/1978 Hilfiker ..... E02D 29/0241 405/284
4,610,568 A * 9/1986 Koerner ..... E02D 17/202 405/15
4,790,690 A * 12/1988 Vidal ..... E02D 29/0225 405/262
4,930,939 A * 6/1990 Jaecklin ..... E02D 29/0241 405/262
4,960,349 A * 10/1990 Willibey ..... D03D 13/006 405/262
6,808,339 B2 * 10/2004 Peterson ..... E02D 29/0216 405/262
7,850,402 B1 * 12/2010 Justiniano ..... A01G 9/1013 405/284
8,246,274 B1 * 8/2012 Hall ..... E02D 17/20 405/262
8,596,928 B1 * 12/2013 Justiniano ..... A01G 9/025 405/284

(Continued)

FOREIGN PATENT DOCUMENTS

CA 2307425 A1 * 11/2000 ..... E02D 17/202
EP 0174253 A2 3/1986

(Continued)

*Primary Examiner* — Frederick L Lagman
(74) *Attorney, Agent, or Firm* — Gearhart Law, LLC

(57) ABSTRACT

The method for the restoration and reinforcement of scarps and a resulting reinforced structure is provided. The method includes of clearing the scarp surface under restoration, and of creating a pit (an excavation). The bottom of the pit is filled with mineral soil and is compacted as a foundation of a retaining wall. A protective filter made from draining mineral soil is installed on the foothill of the scarp, where the protective filter is surrounded by draining geotextile. The geogrid is placed on the surface of the regressed scarp and then anchored to the soil of the scarp by tensile ropes. A rigid support, such as a crib (grillage), is created on the protective filter and batter piles are driven under the rigid support. Then the retaining wall is constructed, consisting of layers of compacted soil that are surrounded by draining geotextile. The retaining wall is covered by erosion control mats, anchored to the draining geotextile of the soil layers of the retaining wall. Protrusion in the scarp is covered with large granite boulders or concrete elements.

20 Claims, 1 Drawing Sheet

(56) References Cited

U.S. PATENT DOCUMENTS

| | | | | |
|---|---|---|---|---|
| 2004/0213636 | A1* | 10/2004 | Russell | E02D 3/10 405/184.4 |
| 2007/0041793 | A1 | 2/2007 | Moss | |
| 2011/0103897 | A1* | 5/2011 | Ruel | E02D 29/02 405/262 |
| 2012/0020745 | A1* | 1/2012 | Miller | E02D 17/202 405/284 |
| 2012/0201606 | A1* | 8/2012 | Dudding | B09B 1/00 405/129.6 |
| 2012/0237299 | A1* | 9/2012 | Dudding | B09B 1/00 405/129.55 |

FOREIGN PATENT DOCUMENTS

| | | | |
|---|---|---|---|
| EP | 0603460 | A1 | 6/1994 |
| RU | 2501911 | * | 12/2013 |
| TW | I262974 | B | 1/2006 |
| WO | 9839518 | A1 | 9/1998 |

* cited by examiner

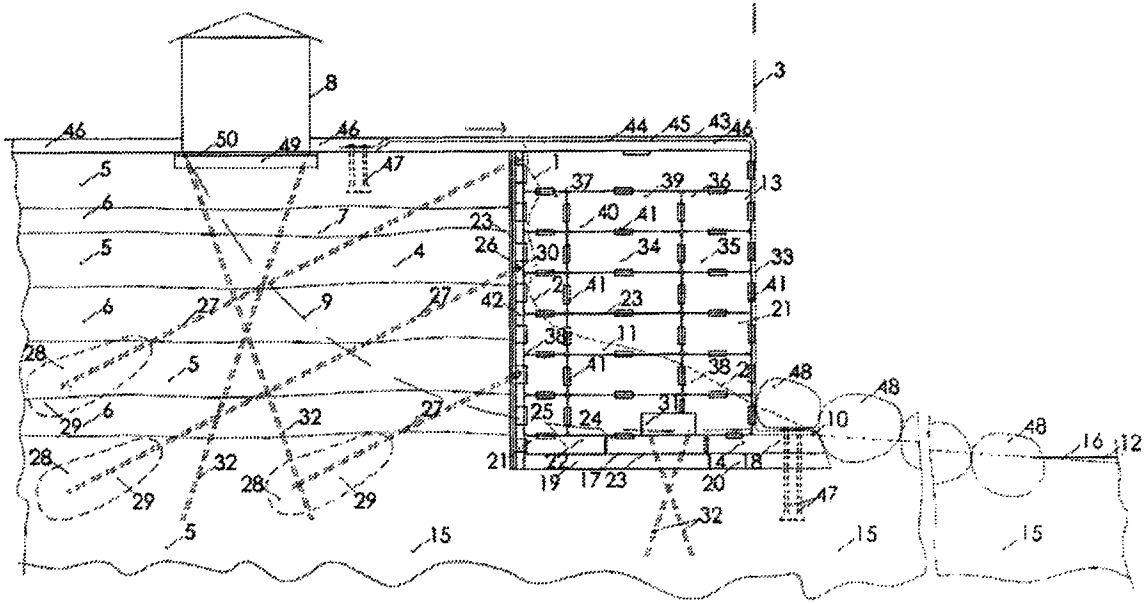

RESTORATION AND REINFORCEMENT OF A SCARP

PRIORITY

This application claims priority of the Estonian national application number U201300097 filed on Dec. 10, 2013, the content of which is incorporated herein by reference in its entirety.

TECHNICAL FIELD

The invention belongs to the field of construction and preservation of natural environment, more particularly, restoration, reinforcement scarps or a steep slope, preservation of its natural state as well as prevention of erosion and landslips.

BACKGROUND OF THE INVENTION

The coastal scarps of a water body (such as an ocean, sea, river, lake), a valley or artificial pit become weathered and disintegrate by the effect of wind, rain, contained surface water, water flow and significant alteration between minus and plus degrees of outdoor temperature (incl. disintegration resulting from volumetric expansion of freezing soil and then shrinking of the expanded soil in the course of thawing). In addition, numerous landslips of the scarp soil occur as a result of human activity or earthquakes.

Natural slopes or scarps have predominantly a very complex structure and the quantity and state of surface water contained in the scarp as well as the causes of erosion are dependent on very many factors (such as rainfall, wind, outdoor air temperature, etc.). Whilst these factors and the intensity of their effect change in time. Numerous factors have been determined empirically, wherefore it is necessary to make significantly allowance for high safety margins in solution planning. Therefore the solutions for ensuring the stability of a scarps, for example, when building a retaining wall, should also account for various climatic, geological and hydrogeological conditions and thus these solutions are by nature very elaborate, resource-intense, multifaceted and diverse.

Well-known methods of scarps reinforcement include facilities from artificial materials, such as retaining walls of steel, stone, reinforced concrete and composite materials, or stabilization of soil by means of hardening compounds and reinforcement with geo-materials. These solutions change the natural environment on a major scale, have high substantially costs, are resource-intense and also in addition to creating the systems for draining the rainwater and surface from the soil require the application of measures for soil hardening.

These well-known solutions are noted below:

Noted solution (WO9839518, Eardley D. J, Martin B, published Nov. 9, 1998), where for the purpose of reinforcement a base frame is installed at the bottom of the body of water. A ballast supporting member is fixed to the base frame, and ballast, such as rocks, can be mounted to the frame, and the frame can be anchored in position. A barrier wall is fixed to the frame.

Noted solution (TW1262974, Lee Der-Her, Yang Yi-En, published Jan. 10, 2006) for slope protection, with the following structure: filter layers, metal frames, soil with vegetation, a retaining wall and drains. The slope is excavated to form steps, platforms and transverse drains in the slope. Drains and platforms are laid at the foot of each step in the slope. The fastening elements of the metal frames are positioned on the retaining wall, platform and drains. The vertical elements of the metal frame are assembled to form vertical units of the metal frame along the slope. The transverse elements of metal frames are assembled to cover the slope. Vegetation soils and vegetation belts are laid on the metal frame, the plants grow through the metal frame and protect the slope against erosion.

Noted solution (EP0174253, France Etat, Mur Ebal Sarl, published Dec. 3, 1986), which uses the covering of a bank with compacted soil, while the mass of earth is reinforced with plates of geotextile. The facing for the bank is formed of plates that are individually hooked to the bank by means of flexible elements. The plates are installed mainly in horizontal rows, while the plates of one row partially overlap the plates of the row immediately beneath.

Noted solution (EP0603460, RDB Plastotecnica SPA, published Jun. 29, 1994), which uses an internally reinforced geotechnical structure with an exposed surface, suitable for the formation of slopes, walls and systems for the prevention of erosion. The structure comprises of several layers, which are superimposed and have their exposed surface either in a vertical or tapered form aligned from the base to the top. Each layer consist of at least one primary reinforcement and a separation element, which is arranged so that the primary segment lies along the horizontal plane: Then it is folded onto itself, the folded segment continues with a second segment in order to contain at least one portion of material. Outwards by the folded segment, i.e. towards the first segment, each layer has a second reinforcement element that preferably consists of a containment frame for containing the bulk material, which covers the first reinforcement layer.

The most technically similar to the presented one is the method for slope reinforcement by means of geosynthetic materials (US2007041793, MEGA, INC, published Feb. 22, 2007). The presented solution contains the following stages: preparation of the soil remaining under the reinforcement; containers made from geosynthetic material are placed on the prepared surface; the containers are filled with fine-grained material; then the reinforcement structure is erected and at least one structure is reinforced for supporting the container structure; the material for covering the surface of the structure and the fill material of containers is selected; the area behind the containers is filled with soil and a drain layer and water guiding pipelines are installed in the slope prior to the installation of containers.

These noted solutions, however, fail to provide scarps with sufficient stability against extreme as well as normal exposure factors occurring over time. Protection is needed for the slopes of soil or scarps against freeze-thaw effects and against various impacts of erosion, waves of water bodies, flow of water, ice, earthquakes or human activity. The systems for draining surface water from behind the retaining wall and the retaining walls themselves require maintenance, repair, and are destroyed in earthquakes due to dislocation resulting from compaction of scarp soil or substantial or abrupt changes in the state and volume of the surface water in the scarp. Retaining walls that are produced from soil stabilised with cement or oil-shale ash, or from fine-grained (i.e. non-drain or low-drain) soil also require drainage pipelines.

SUMMARY OF THE INVENTION

In order to stop weather-related erosion and prevent the slip or decomposition of scarp soil as a result of exposure to geophysical or human factors and to restore scarp sections to their natural condition, a retaining wall is created of layers of compacted filtering mineral soil surrounded by pre-tensioned geotextile. The retaining wall is created up to the initial height and width of the scarp. The retaining wall ensures the stability of the scarp soil that is at risk of slips. The soil layers of the retaining wall are composed of parts with different geophysical properties (incl. filtration rate, granulometric composition). At the same time, parts of the soil layers of the retaining wall also form a vertical and horizontal protective filter, ensuring thereby natural water regime of the soil parts of different nature in the scarp, and protecting the various soil layers of the scarp against the impact of changes in outdoor temperature and state of the surface water, as well as against other effects, such as waves, water flow, rain, ice, wind, earthquake, vibration caused by human activities, etc.

The retaining wall is covered on top with erosion control mats, which are reinforced with a double mesh of inert material and contain materials that promote plant growth, resulting in a supplementary naturally renewing, biologically stable grid that protects the scarp surface at the front and on top of the restored scarp, preventing the erosion at the front face of the scarp.

In case of high scarps or steep slopes the retaining walls are created in steps in the form of terraces running along the slope over the whole area at risk of land slips, thus ensuring stability of high scarp as well.

Provided is a method for restoration and reinforcement of a scarp comprising a surface, a front edge, a foothill, and a firm soil layer, said method comprising the steps of: a) preparation of the surface of the scarp by removing weathered soil; b) creating a pit below the foothill and filling the pit with a layer of mineral soil with coarse-grain granulometric composition, and compacting the mineral soil to the subsoil to form a foundation for a retaining wall, with a minimum downward gradient of two percent away from the scarp; c) creating a horizontal protective filter at the foothill and being formed of compacted draining mineral soil and surrounded by pre-tensioned draining geotextile, wherein the horizontal protective filter comprises soil sections with different seepage coefficients and the soil sections of different seepage coefficients being separated from one another by a pre-tensioned geotextile; d)installing a geogrid of inert material on the surface of the scarp and anchoring the geogrid to the firm soil layer of the scarp with tensile ropes; e) installing a draining geotextile under the geogrid; f) creating a rigid support on top of the horizontal protective filter; g)sinking batter piles under the rigid support and intersecting the piles at a horizontal line parallel to the front edge of the scarp and at a vertical plane runnings through center of gravity of the rigid support to act on pull and pressure, and supporting the piles on firm soil layer in the subsoil; h) creating a retaining wall containing multiple layers filled with compacted mineral soil surrounded by pre-tensioned geotextile, wherein each soil layer is formed of an internal, an external and at least one middle soil layer section with different granulometric compositions, and the external and the internal soil layer sections of the retaining wall being formed of draining mineral soil and constituting vertical protective filters of restored scarp, and the middle sections of the retaining wall being formed of fine-grain soil; i) covering the retaining wall with erosion control mats secured to the geotextile surrounding the mineral soil layers of the retaining wall with clamps of inert material; and j) creating a support for the retaining wall at the foothill of the scarp by installing a counterweight.

Provided is also a reinforced scarp structure comprising: a) a scarp surface restored by removing weathered soil; b) a scarp front edge; c) a scarp foothill; d) a firm soil layer; e) retaining wall structure, said retaining wall structure comprising: i) a foundation comprising a layer of mineral soil with coarse-grain granulometric composition compacted to subsoil, and said foundation having a minimum downward gradient of two percent away from the scarp; ii) a horizontal protective filter comprising compacted draining mineral soil and surrounded by pre-tensioned draining geotextile at the foothill of the scarp, wherein the horizontal protective filter comprises soil sections with different seepage coefficients and the soil sections of different seepage coefficients are separated from one another by a pre-tensioned geotextile; iii) a geogrid of inert material on the surface of the scarp anchored to the firm soil layer of the scarp with tensile ropes; iv) a draining geotextile under the geogrid; v) a rigid support on top of the horizontal protective filter ;vi) multitude of batter piles under the rigid support said piles intersecting at a horizontal line parallel to the front edge of the scarp and at a vertical plane running through center of gravity of the rigid support, and the piles being supported on firm soil layer in subsoil; vii) a retaining wall containing layers filled with compacted mineral soil surrounded by pre-tensioned geotextile, wherein each soil layer of the retaining wall has an internal, an external, and at least one middle soil layer sections with different granulometric compositions, and the external and the internal soil layer sections comprise draining mineral soil and form vertical protective filters of the scarp, and the middle sections of the etaining wall comprise fine-grain soil; viii) control mats secured to the geotextile surrounding the mineral soil layers of the retaining wall with clamps of inert material; and f) one or more counterweights supporting the retaining wall at the foothill of the scarp.

BRIEF DESCRIPTION OF THE DRAWINGS

FIG. 1 presents a cross-section of a restored and reinforced scarp according to this invention.

DETAILED DESCRIPTION OF THE INVENTION

The example excecution of the invention is scarp 1, where the front face 2 has substantially regressed from original boundary 3 due to erosion or landslips. Scarp body 4 is formed by soil layers and sections 5, 6 of different geotechnical properties, in which harder soil layers 5 of different petrification stadiums and weaker soil layers 6 that become leached upon saturation with water, are dominant. At a slip-prone area 7 of the remaining scarps is building 8 as an artificial load, for which caving along possible slip surface 9 is also probable as a result of the future impacts of erosion of scarp 1, its geophysical factors, earthquakes or human activities in the course of time. At this the surface layers of front face 2 of the scarp, incl. front face 2, decompose through freezing and thawing and fall at the foothill 10 of the scarp, from where the loose or weathered soil 11 is washed away from the scarp foothill 10 by the action of waves, water flow and rain, often into water body 12, such as a sea or a river. At this the front face 2 of the scarp remains continuously exposed to the action of waves, water flow and ice of the water body, such as a sea or a river.

For the restoration and reinforcement of scarp 1, foothill 10 and front face 2 of the regressed scarp is cleared of weathered soil 11, and a pit 14 for retaining wall 13 is created in subsoil 15 below scarp foothill 10 (below the minimum level 16 of the water body in case of a bank of a water body). In case of weak subsoil 15, the bottom 17 of pit 14 is filled with layer 18 of mineral soil with coarse granulometric composition, whereas the layer of mineral backfill is created with the minimum thickness 0.1-0.5 m and is compacted to subsoil 15 so that a firm, even and level soil layer 19 is formed, with the minimum downward gradient of two per cent away from scarp 1, functioning as the foundation 20 of retaining wall 13 and future works. In case of firm subsoil 15, such as rock, the foundation 20 of the retaining wall is formed from subsoil 15 by shaping it with a minimum downward gradient of two per cent away from scarp 1.

After the formation of foundation 20 of the retaining wall, i.e. a sub-layer or a working layer, a horizontal protective filter 22 of draining mineral soil 21 is installed at the foothill 10 of the existing scarp, reaching over the boundary 3 of the initial scarp by the double thickness of the horizontal protective filter. The horizontal protective filter 22 is surrounded by draining geotextile 23. The horizontal protective filter 22 is formed of soil sections 24 of different properties, while the seepage coefficient thereof substantially increases towards water outlet. The seepage coefficient of the first soil section 25 of horizontal protective filter 22 is two m/day, which is the soil section 24 of the protective filter with the smallest seepage coefficient.

Soil sections 24 of protective filter of different seepage coefficient, which differ from one another by four or eight times in average (seepage coefficients e.g. two m/day, eight m/day and sixteen m/day) are separated from one another also by means of draining geotextile 23, whereat geotextile 23 is pre-tensioned. The thickness of horizontal protective filter 22 is selected so that a filter section with the width of one metre would have the capacity to filter in a time unit the maximum amount of surface water and rainwater seeping through a scarp width of one metre in one and a half times at minimum.

In order to ensure sufficient safety margin for the stability of the soil of existing scarp 1 and stability for the compensation of extreme weather conditions (such as rainfall or absolute minimums of outdoor temperature with occurrence probability in more than 100 years at various time periods) or geological or human impact, geogrid 26 of inert material, such as stainless steel or synthetic geomaterial, is placed on the surface of the regressed scarp and anchored into the firm soil layer 5 beneath possible slip soil 9 in scarp 1 by means of inclined tensile ropes 27.

The anchors 28 of tensile ropes 27 are formed, for example, by pressing hardening liquid compound 29 into the firm soil layer 5 surrounding the end area of tensile rope 27. Tensile ropes 27 are tensioned after the formation (hardening) of anchors 28 by means of respective tension screws 30, resulting also in tensioning of geotextile 26 that supports the scarp, and the soil becomes tensioned, transforming the soil section of the regressed front face of scarp 1 into a monolith that stabilises the scarp, compensating thereby the horizontal pressure on soil on the front part of scarp 1 and stability of scarp 1 in case of loads caused by extraordinary and extreme factors. Depending on the geophysical properties of the soil of scarp 1, draining geotextile 23 is installed under geogrid 26 prior to the installation of the latter, to maintain the water flow in the soil even and prevent small soil particles from washing out with water.

A rigid support 31 i.e a grillage is built of reinforced concrete on top of the horizontal protective filter 22, installing batter piles 32 underneath, which act on pull and pressure. At this, one row of piles is installed at an angle towards scarp 1 and act on pull, while the other row of piles is installed at an angle away from scarp 1 and acts on pressure. Batter piles 32 are installed so that the piles intersect under rigid support 31 on the vertical plane crossing its centre of gravity, at the same horizontal line that runs in parallel with the initial front face 3 of scarp 1. Such arrangement of batter piles 32 ensures flexible deformation of rigid support 31 perpendicularly to scarp 1 around the horizontal line at the plane crossing the centre of gravity of rigid support 31 in case of earthquake or artificial vibration, and prevents the destruction of rigid support 31, when compared with the arrangement of rigid piles in known solutions. At the same time rigid support 31 supports vertically retaining wall 13 and avoids land slip in the scarp.

Rigid support 31 is installed at the distance of ⅓ of the width of retaining wall 13 from the front edge of retaining wall 13, i.e. from the original front edge 33 of the scarp. Such rigid base 31 and its arrangement ensures pre-tensioning of the draining geotextile surrounding the soil layers 34 of retaining wall 13 during the compacting of soil layers 34, as the soil layers 34 of retaining wall 13 that are surrounded by geotextile become compact and geotextiles 23 become tensioned with the downwards movement, since the parts of retaining wall 13 that are located on rigid support 31, i.e. the soil layers 34 of retaining wall 13, are not sinking downwards by the same volume. The geotextile 23 of soil layer 34 of retaining wall 13 becomes tensioned, because the perimeter of soil layer 34 surrounded by geotextile increases with the elongation of the cross-section of the layer during soil compacting and the geotextile stretches flexibly and thus is pre-tensioned before it is seated in its final working position.

Then the retaining wall 13 is created, containing compacted layers 34 of mineral soil. The compacted layers 34 of mineral soil are formed of parts 35 of soil layers with different geophysical properties, surrounded by geotextile 23. The soil layer parts 35, which will locate on the outer surface 36 and inner surface 37 of the restored scarp section, are created from draining mineral soil 21, and these soil parts form the vertical protection filters 38 of the retaining wall. The width of the vertical protective filter 38 located on the outer surface 36 of the scarp, i.e. the width of the draining soil part on the outer surface layer of the retaining wall, is higher in the direction intersecting with the front edge 33 of the scarp than the maximum freezing depth of soil at the location of the scarp, while the maximum freezing depth has been determined on the basis of actual data from years of measurement (over 100 years).

Depending on the distance of the excavation site of fine-grain soils 39 and draining mineral soils 21 from the scarp, the middle sections 40 of the scarp soil layers 34 are created either from fine-grain mineral soil 39 or draining mineral soil 21. In most cases, draining mineral soil 21 is less frequently available in nature than fine-grain (i.e. non-draining) soil 39. If there is draining mineral soil 21 available near the scarp, soil layers 34 are created only from the draining mineral soil 21. If draining mineral soil 21 is unavailable near scarp 1, the existing granular soil, i.e. fine-grain mineral soil 39, is sieved into fractions of different granulometric composition, obtaining the draining mineral soil 21 with uniform grain size (i.e. from the part with more coarse, uniform granulometric composition), in which the cohesion force of water between grains (i.e. cohesiveness of soil) is not dominant and the capillary rise of water in the soil remains insignificant.

The front face of the retaining wall of the scarp under restoration is installed so that it coincides with scarp boundary 3 and is created upright or at a grade contingent on natural or functional conditions.

Soil layers 34 of retaining wall 13 are created by first installing the draining geotextile 23 and then installing, compacting by layers, the draining mineral soil 21 with seepage coefficient of two m/day at minimum up to soil layer thickness of ⅙-1/10 of the width of soil layer 34. Then the soil layer 34 of retaining wall is covered with geotextile 23, the ends and sides of which are installed with overlap that is approx. ⅕-1/10 of the length of soil layer thickness, are pre-tensioned and mutually anchored by means of stainless steel clamps 41 or by seaming with a rope of inert material, such as geotextile.

The soil layers 34 of retaining wall 13 are compacted to the compression degree of 0.98 at minimum. In addition to supplementary tensioning of geotextile 23 surrounding the soil layers 34 of retaining wall during compacting, the horizontal friction between layers of the retaining wall also increases substantially (soil layers 34 of retaining wall are arranged at an angle towards retaining wall 13 of scarp 1, and in case of lateral pressure of the soil to be supported, the compressive force should first exceed the weight of retaining wall 13, which is substantially higher than the frictional force of soil layer 34 of the retaining wall), wherefore the shifting of soil layers 34 of the retaining wall 13 in relation to one another and the deflection or shifting of retaining wall 13 externally, overreaching scarp 1 is excluded due to the horizontal pressure of scarp soil. Because of the flexible pretension of geotextile 23, soil layers 34 of the retaining wall constitute uniform stable body and form and are resistant to the lateral pressure of soil in scarp 1 and to external factors. The tensile strength of geotextile 23 is 50 KN at minimum per section with the width of one metre and is sufficient for receiving the lateral pressure of soil.

The voids 42 remaining between the front face 2 of scarp supported with cleared and tensioned geogrid 26 and the soil layers 34 of retaining wall 13 are filled with draining mineral soil 21, which has the minimum seepage coefficient of two m/day and is compacted to the minimum compression degree of 0.98.

After filling and compacting the voids, the geotextile 23 of the soil layers 34 of retaining wall is bound (having previously removed the layer of weathered and loose soil 11) by means of clamps of inert material to the pre-tensioned geogrid 26 and geotextile 23 of the front face 2 of the scarp.

Generating the flexible pretension in the geotextile 23 surrounding the soil layers 34 of retaining wall 13 ensures flexible functioning of the whole retaining wall 13, receiving the deformations caused by vibration and not permitting the retaining wall 13 to decompose or become fractioned due to vibration caused by earthquakes or machines or due to wave-form morphological deformation of soil as a result of earthquakes.

The seepage coefficient of draining mineral soil layer sections 35 of soil layers 34 of retaining wall 13, located on the outside 36 and inside 37 of the restored scarp, increases from top to bottom, being two m/day at minimum in the upper layer. Thereby, a vertical protective filter 38 has been formed in retaining wall 13, the first step of which is the draining geotextile 23 that covers the surface of the existing scarp. Due to the good draining capacity of the draining mineral soil 21 of the surface soils 34 of the retaining wall there is no permanently free water (such as gravitational water, percolating water, leachate) in soil layers 34 of the retaining wall and therefore major deformations in retaining wall 13 as a result of freezing of soil at below zero temperatures and re-thawing are excluded.

Retaining wall 13 is covered on top with erosion control mats 43. Erosion control mats 43 are reinforced with double grid of inert material 44, such as UV-resistant polypropylene mesh, and contain materials 45 that promote organic plant growth (such as vegetation soil with 100% of coconut fibre, straw or a mixture of straw and coconut fibre and plant seeds) and plant seeds 25 grams per one square metre at minimum. The variety of plant seeds is selected according to growing capacity at the slope on the external face of the retaining wall and according to climatic conditions. The erosion control mats 43 are anchored to geotextiles 23 of the soil layers 34 of the retaining wall by means of clamps 41 of inert material, such as 3-4 clamps of stainless steel per 1 $m^2$ at minimum, or by sewing with a string of geomaterial. The front edge of an erosion control mat is placed under the growth soil layer 46 of the scarp and is secured into firm soil layer 5 by means of anchoring screws 47. The front edge of the erosion control mat is also secured to subsoil 15 of the scarp at the foothill 10 of the scarp by means of anchoring screws 47.

The foothill 10 of the scarp is planned according to environmental conditions and is covered with counterweight 48 of material suitable for the environment, such as large granite boulders or chloride-resistant and weather-proof elements produced from heavyweight concrete, to protect the scarp from the impacts of waves and ice while also providing a counterweight 48 aligned with possible slip line of the scarp, to balance the slip mass weight formed of soil and artificial load. The material or elements of counterweight 48 are installed at an angle to the body of water, forming thereby an ice breaker, as a result of which horizontally moving ice will break on its way to the scarp and accumulate at the foothill 10 of scarp 1.

As a supplementary measure at which also the geophysical conditions and geotechnical factors of subsoil layers 5 and 6 of the scarp are proceeded from, foundation 49 of artificial load located in the slip-prone area 7 of scarp 1, such as building 8, is reinforced with batter piles 32 down to firm soil layer 5 located below possible slip soil 9. Batter piles 32 are sunk or driven at an angle and intersect in the soil under building 8 at the horizontal line, which is parallel to the edge of the restored scarp (original natural front edge of the scarp), of a vertical plane passing through the centre of gravity of the building. Such an arrangement of batter piles 32 ensures horizontal flexible wave-form movement of building 8 in the direction of a possible slip; however, the vertical pressure is received by batter piles 32 and due to this earthquakes do not cause landslips and destruction of the structures of building 8.. Batter piles 32 are connected by means of horizontal tensioning elements 50 in the plane of foundation 49 of building 8, thereby compensating the horizontal pressure of batter piles 32 on foundation 49 of building 8.

The same measure is applied when constructing new buildings 8 to scarp 1, i.e. these are supported with batter piles 32 (according to above-described solution, similarly to the execution of supporting an existing building 8 with batter piles 32) on the firm soil layer 5 located under possible slip soil 9, avoiding additional load on the slip-prone area 7 of the scarp with this solution.

At the same time, the top area and foot area of the retaining wall of restored scarp section can be used in addition (if needed) for the creation of building 8, whereby an additional stability factor for the functioning (preservation) of the retaining wall 13 of scarp 1 is achieved, because a supplementary counterweight 48 is created against the pressure of slip-prone soil mass 7 of scarp 1 and building 8.

Considering the fact that mineral soil is a natural material, which is easy to process with machinery, and that the quantity of artificial geotextile, which is mainly produced from wastes, is relatively minimum, a solution is achieved that persists over time, changes the natural environment only by a minimum over the whole life cycle of the scarp in comparison with retaining walls of resource-intense artificial materials, such as reinforced concrete or steel.

Since a retaining wall with layers of compacted mineral soil surrounded by pre-tensioned geotextile constitutes a vertical as well as horizontal protective filter for guiding surface water and rainwater out from the scarp then creating, repairing and servicing of an additional system of drainage pipelines for guiding water out from behind a retaining wall made from concrete or steel (or another non-draining material)

becomes unnecessary. Surface water flows out from the vertical and horizontal protective filter in a short time. Thereby also the deformations contingent on changes in outdoor temperatures (incl. morphological deformations caused by freezing and thawing of soil) are excluded, since water, which expands with freezing, has been guided out from the soil. At the same time, the pre-tensioned retaining wall of compacted soil layers surrounded by geotextile is sufficiently flexible while also compact for the purpose of compensating deformations that could destroy and decompose the scarp as well as the retaining wall due to the impact of waves or vibrations caused by earthquakes and human activity. Pre-tensioning of the geotextile and geogrid before it starts to function in the system of the retaining wall of the scarp contributes to maximum and efficient application of geotextile as a structural material in comparison to known solutions in which geotextile is not pre-tensioned and due to the elasticity of which major deformations occur before the maximum tensile strength of the geotextile has been reached.

What is claimed is:

1. A method for restoration and reinforcement of a scarp comprising a surface, a front edge, a foothill, and a firm soil layer, said method comprising the steps of:

a) preparation of the surface of the scarp by removing weathered soil;

b) creating a pit below the foothill and filling the pit with a layer of mineral soil with coarse-grain granulometric composition, and compacting the mineral soil to the subsoil to form a foundation for a retaining wall, with a minimum downward gradient of two percent away from the scarp;

c) creating a horizontal protective filter at the foothill and being formed of compacted draining mineral soil and surrounded by pre-tensioned draining geotextile, wherein the horizontal protective filter comprises soil sections with different seepage coefficients and the soil sections of different seepage coefficients being separated from one another by a pre-tensioned geotextile;

d) installing a geogrid of inert material on the surface of the scarp and anchoring the geogrid to the firm soil layer of the scarp with tensile ropes;

e) installing a draining geotextile under the geogrid;

f) creating a rigid support on top of the horizontal protective filter;

g) sinking batter piles under the rigid support and intersecting the piles at a horizontal line parallel to the front edge of the scarp and at a vertical plane running through a center of gravity of the rigid support to act on pull and pressure, and supporting the piles on firm soil layer in the subsoil;

h) creating a retaining wall containing multiple layers filled with compacted mineral soil surrounded by pre-tensioned geotextile, wherein each soil layer is formed of an internal, an external and at least one middle soil layer section with different granulometric compositions, and the external and the internal soil layer sections of the retaining wall being formed of draining mineral soil and constituting vertical protective filters of restored scarp, and the middle sections of the retaining wall being formed of fine-grain soil;

i) covering the retaining wall with erosion control mats secured to the geotextile surrounding the mineral soil layers of the retaining wall with clamps of inert material; and j) creating a support for the retaining wall at the foothill of the scarp by installing a counterweight.

2. The method of claim 1, wherein the method includes creating support to an existing building on a slip-prone area of the scarp and wherein building foundation is supported with batter piles to a firm soil layer underneath the scarp.

3. The method according to claim 1, wherein a width of the external soil sections exceeds maximum freezing depth of soil at the location of the scarp.

4. The method according to claim 1, wherein bottom of the pit is filled with mineral soil of coarse-grain granulometric composition in a layer with a minimum thickness of 0.1-0.5 m.

5. The method according to claim 1, wherein the horizontal protective filter reaches over original front edge of initial scarp by double of the thickness of the horizontal protective filter.

6. The method according to claim 1, wherein the thickness of the horizontal protective filter is chosen so that a filter section with the width of one meter would have a capacity to filter in a time unit a maximum amount of surface water and rainwater seeping through a scarp width of one meter in one and a half time units at minimum.

7. The method according to claim 1, wherein the geogrid is of stainless steel or synthetic geomaterial.

8. The method according to claim 1, wherein one row of batter piles is installed at an angle towards the scarp and a second row of piles is installed at an angle away from the scarp.

9. The method according to claim 1, wherein the rigid support is installed at a distance of ⅓ of width of the retaining wall from the front edge of the retaining wall.

10. The method according to claim 1, wherein the rigid support is a grillage of reinforced concrete.

11. The method according to claim 1, wherein the soil layer sections of the soil layers of the retaining wall and the soil of the horizontal protective filter are compacted to the compression degree of 0.98 at minimum.

12. The method according to claim 1, wherein the erosion control mats are reinforced with a double grid of inert material and the inert material is UV-resistant polypropylene.

13. The method according to claim 1, wherein the erosion control mats contain organic materials that promote plant growth.

14. The method according to claim 1, wherein the counterweight is constituted by draining mineral soil with coarse-grain granulometric composition, large granite boulders, or weather-proof and chloride-resistant elements of heavy-weight concrete.

15. The method according to claim 2, wherein the batter piles supporting the foundation of the building are sunk or driven, and intersecting with the horizontal line of a vertical plane passing through the center of gravity of the building, and the horizontal line is parallel to the front edge of the scarp.

16. The method according to claim 15, wherein the batter piles are connected with horizontal tensioning elements at the plane of the foundation of the building.

17. The method according to claim 1, wherein edges of the erosion control mats on and at the foothill of the scarp are secured to the firm soil of the scarp with anchoring screws.

18. The method according to claim 1, wherein the counterweight is installed towards a body of water in an angle which contributes to breaking the ice of the body of water at its horizontal movement towards the scarp in a way that an ice breaker is formed and ice accumulates at the foothill of the scarp, while not demolishing the front face of the scarp and the erosion control mat of the retaining wall.

19. A reinforced scarp structure comprising:

a) a scarp surface restored by removing weathered soil;

b) a scarp front edge;

c) a scarp foothill;

d) a firm soil layer;

e) retaining wall structure, said retaining wall structure comprising:

i) a foundation comprising a layer of mineral soil with coarse-grain granulometric composition compacted to subsoil, and said foundation having a minimum downward gradient of two percent away from the scarp;

ii) a horizontal protective filter comprising compacted draining mineral soil and surrounded by pre-tensioned draining geotextile at the foothill of the scarp, wherein the horizontal protective filter comprises soil sections with different seepage coefficients and the soil sections of different seepage coefficients are separated from one another by a pre-tensioned geotextile;

iii) a geogrid of inert material on the surface of the scarp anchored to the firm soil layer of the scarp with tensile ropes;

iv) a draining geotextile under the geogrid;

v) a rigid support on top of the horizontal protective filter;

vi) multitude of batter piles under the rigid support said piles intersecting at a horizontal line parallel to the front edge of the scarp and at a vertical plane running through a center of gravity of the rigid support, and the piles being supported on firm soil layer in subsoil;

vii) the retaining wall containing layers filled with compacted mineral soil surrounded by pre-tensioned geotextile, wherein each soil layer of the retaining wall has an internal, an external, and at least one middle soil layer sections with different granulometric compositions, and the external and the internal soil layer sections comprise draining mineral soil and form vertical protective filters of the scarp, and the middle sections of the retaining wall comprise fine-grain soil;

viii) control mats secured to the geotextile surrounding the mineral soil layers of the retaining wall with clamps of inert material; and f) one or more counterweights supporting the retaining wall at the foothill of the scarp.

20. A restoring and reinforcing structure for a scarp, wherein the structure comprises:

a) a foundation comprising a layer of mineral soil with coarse-grain granulometric composition compacted to subsoil, said foundation having a minimum downward gradient of two percent away from the scarp;

b) a horizontal protective filter on top of the foundation, said filter comprising soil sections with different seepage coefficients and the sections being separated from one another by a pre-tensioned geotextile;

c) a rigid support on top of the horizontal protective filter, and multitude batter piles under the rigid support, wherein the piles intersect at a horizontal line parallel to the front edge of the scarp and at a vertical plane running through a center of gravity of the rigid support, and wherein the piles are supported on firm soil layer of subsoil;

d) a retaining wall on top of the rigid support and the horizontal protective filter, said retaining wall comprising multiple layers filled with compacted mineral soil and surrounded by pre-tensioned geotextile, wherein each soil layer is formed of an internal, an external and at least one middle soil layer section with different granulometric composition, and the external and the internal soil layer section being formed of draining mineral soil and constituting vertical protective filters;

e) at least one counterweight at the foothill of the scarp to support the retaining wall; and f) a cover comprising erosion control mats secured to the geotextile surrounding the mineral soil layers of the retaining walls.

* * * * *